US009650944B2

(12) United States Patent
Pöhmerer et al.

(10) Patent No.: US 9,650,944 B2
(45) Date of Patent: May 16, 2017

(54) METHOD AND DEVICE FOR CHECKING A CONTROL DEVICE

(75) Inventors: Wolf-Dieter Pöhmerer, Bad Abbach (DE); Andreas Gallhuber, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 959 days.

(21) Appl. No.: 13/983,081

(22) PCT Filed: Jan. 16, 2012

(86) PCT No.: PCT/EP2012/050557

§ 371 (c)(1),
(2), (4) Date: Aug. 1, 2013

(87) PCT Pub. No.: WO2012/104133

PCT Pub. Date: Aug. 9, 2012

(65) Prior Publication Data

US 2013/0325406 A1 Dec. 5, 2013

(30) Foreign Application Priority Data

Feb. 1, 2011 (DE) ..... 10 2011 003 430

(51) Int. Cl.
*G06F 11/30* (2006.01)
*F01P 11/14* (2006.01)
*F01P 7/16* (2006.01)

(52) U.S. Cl.
CPC ..... *F01P 11/14* (2013.01); *F01P 7/167* (2013.01); *F01P 2023/08* (2013.01); *F01P 2031/00* (2013.01)

(58) Field of Classification Search
USPC ..... 702/183
See application file for complete search history.

(56) References Cited

U.S. PATENT DOCUMENTS 4,280,682 A * 7/1981 Zukausky ..... B60H 1/00485 251/251
4,785,781 A * 11/1988 Pfalzgraf ..... F02D 11/107 123/198 D (Continued)

FOREIGN PATENT DOCUMENTS

DE 19960931 A1 6/2001 ..... F01P 7/16
JP 2000303842 A 10/2000 ..... F01P 11/16

(Continued)

OTHER PUBLICATIONS

International Search Report and Written Opinion, Application No. PCT/EP2012/050557, 12 pages, May 10, 2012.

*Primary Examiner* — Paul D Lee
(74) *Attorney, Agent, or Firm* — Slayden Grubert Beard PLLC

(57) ABSTRACT

A control device may include an actuator for actuating a final control element on a cooling system of an internal combustion engine and a sensor for scanning a position of the final control element. A method for checking the control device may include the steps of triggering the actuator with a predetermined control signal, determining a progression of the control position scanned by the sensor, and determining the functional capability of the mechanical coupling of the actuator to the final control element on the basis of the predetermined control signal and the determined progression.

17 Claims, 3 Drawing Sheets

(56) References Cited

U.S. PATENT DOCUMENTS

| | | | | |
|---|---|---|---|---|
| 2001/0019252 | A1* | 9/2001 | Watanabe | F02D 11/105 318/727 |
| 2003/0172882 | A1 | 9/2003 | Nakano | 123/41.1 |
| 2005/0006487 | A1 | 1/2005 | Suda et al. | 236/46 R |
| 2005/0211198 | A1* | 9/2005 | Froeschle | F02D 41/20 123/90.11 |
| 2006/0225421 | A1* | 10/2006 | Yamanaka | F02G 5/00 60/645 |
| 2013/0325406 | A1 | 12/2013 | Pöhmerer et al. | 702/183 |

FOREIGN PATENT DOCUMENTS

| | | | | |
|---|---|---|---|---|
| WO | 01/42637 | A2 | 6/2001 | F02D 35/00 |
| WO | 2012/104133 | A1 | 8/2012 | F01P 7/16 |

* cited by examiner

METHOD AND DEVICE FOR CHECKING A CONTROL DEVICE

CROSS-REFERENCE TO RELATED APPLICATIONS

This application is a U.S. National Stage Application of International Application No. PCT/EP2012/050557 filed Jan. 16, 2012, which designates the United States of America, and claims priority to DE Application No. 10 2011 003 430.7 filed Feb. 1, 2011, the contents of which are hereby incorporated by reference in their entirety.

TECHNICAL FIELD

This disclosure relates to a method and to an apparatus for checking a control device. In this case, the control device comprises an actuator for operating an actuating element and a sensor for reading a position of the actuating element.

BACKGROUND

Closed-loop control circuits are used in technical applications in order to move an actuating element to a predetermined position. By way of example, an electric motor can be used to change a rotation angle of a shaft, wherein a sensor is provided for reading the rotation angle of the shaft. As a function of a predetermined rotation angle and the rotation angle which is determined by the sensor, a control device provides a suitable signal to the electric motor in order to rotate the shaft in such a way that the read rotation angle corresponds to the predetermined rotation angle. The shaft can act on an actuating element, for example in order to influence a variable in another closed-loop control circuit. If the mechanical coupling between the shaft and the actuating element is now damaged, this cannot initially be established on the basis of the sensor signal since the sensor can still be moved to the predetermined rotation angle.

SUMMARY

One embodiment provides a method for checking a control device, wherein the control device comprises an actuator for operating an actuating element in a cooling system of a internal combustion engine and a sensor for reading a position of the actuating element, comprising the following steps: actuating the actuator with a predetermined control signal; determining a profile of the actuating position which is read by the sensor; and determining the functioning of the mechanical coupling of the actuator to the actuating element on the basis of the predetermined control signal and the determined profile.

In a further embodiment, a predetermined profile is associated with the predetermined control signal, and a defect in the mechanical coupling is determined if the determined profile deviates from the predetermined profile by more than a predetermined amount.

In a further embodiment, a dynamic parameter of the mechanical coupling is determined on the basis of the determined profile, and a defect in the mechanical coupling is determined if the determined parameter deviates from a predetermined parameter by more than a predetermined amount.

In a further embodiment, the parameter comprises mechanical damping.

In a further embodiment, the parameter comprises mechanical inertia.

In a further embodiment, the control device is part of a closed-loop control circuit for controlling a variable, and actuation is performed when the closed-loop control circuit is deactivated, so that the control device has no effect on the controlled variable.

In a further embodiment, the closed-loop control circuit comprises a temperature control means for a cooling system for cooling an internal combustion engine in a motor vehicle, and actuation is performed when the internal combustion engine is turned off.

In a further embodiment, the actuation is performed when the cooling system is also turned off.

Another embodiment provides a computer program product having program code means for carrying out a method as claimed in one of the preceding claims, when the computer program product is run on a processing device or is stored in a computer-readable data storage medium.

Another embodiment provides an apparatus for checking a control device, wherein the control device comprises an actuator for operating an actuating element in a cooling system of an internal combustion engine and a sensor for reading a position of the actuating element, wherein the apparatus comprises the following elements: a processing device for actuating the actuator with a predetermined control signal; a reading device for determining a profile of the actuating position which is read by the sensor, wherein the processing device is designed to determine the functioning of the mechanical coupling of the actuator to the actuating element on the basis of the predetermined control signal and the determined profile.

In a further embodiment, the apparatus comprises a memory in which a predetermined profile of the actuating position which is associated with the control signal is stored, wherein the processing device is designed to detect a defect in the mechanical coupling if the determined profile deviates from the stored profile by more than a predetermined amount.

BRIEF DESCRIPTION OF THE DRAWINGS

Example embodiments are described in more detail below with reference to the drawings, in which.

DETAILED DESCRIPTION

Figure 1:
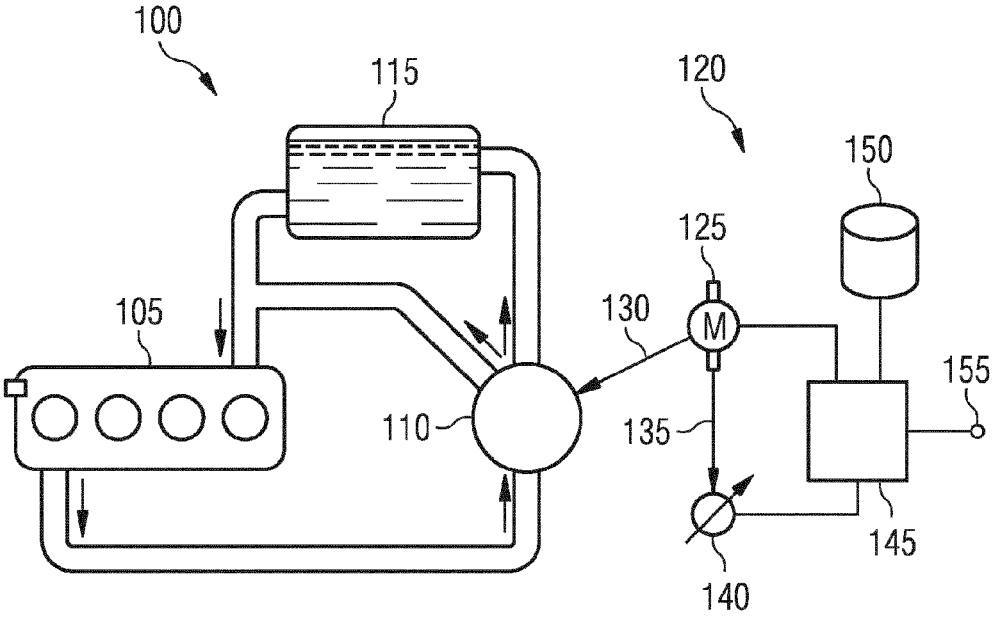
FIG. 1 shows a cooling system in an internal combustion engine of a motor vehicle.

Some embodiments provide a method with which a defect in the mechanical coupling can be determined. Other embodiments provide a corresponding apparatus.

A control device comprises an actuator for operating an actuating element in a cooling system of an internal combustion engine and a sensor for reading a position of the actuating element. A method according to the invention for checking the control device comprises the steps of actuating the actuator with a predetermined control signal, determining a profile of the actuating position which is read by the sensor, and determining the functioning of the mechanical coupling of the actuator to the actuating element on the basis of the predetermined control signal and the profile.

In technical applications in which the sensor is not directly connected to the actuating element, the method can be used to determine a defective mechanical coupling of the actuator to the actuating element, even if the sensor is also mechanically coupled to the actuator. Integrated fault monitoring of the control device can be realized as a result. It is also possible, as a result, to mechanically couple the sensor directly to the actuator instead of to the actuating element, as a result of which a complicated mechanical coupling can be avoided and production costs can be reduced.

The method can be carried out during normal operation of the control device by the profile of the read actuating position being put into context with a control signal which is generated on the basis of an open-loop or closed-loop control function of the control device. Furthermore, a dedicated control signal can be generated which can be meaningfully correlated with the read profile of the actuating position.

In a first embodiment, a predetermined profile is associated with the predetermined control signal, and a defect in the mechanical coupling is determined if the determined profile deviates from the predetermined profile by more than a predetermined amount. The two profiles can be compared in a resource-saving and rapid manner, with the result that it is also possible to carry out the method using simple technical means.

In another embodiment, a dynamic parameter of the mechanical coupling is determined on the basis of the determined profile, and a defect in the mechanical coupling is determined if the determined parameter deviates from a predetermined parameter by more than a predetermined amount. The amount of memory used for the predetermined parameters can be kept low by virtue of the parametric determination of the functioning of the mechanical coupling of the actuator to the actuating element. Furthermore, the dynamic parameter can be provided in order to improve, for example, an open-loop or closed-loop control function of the control device.

The mechanical parameter can comprise mechanical damping and/or mechanical inertia. As a result, a defect in the mechanical coupling can be determined in a rapid and precise manner. In particular, a defect which is only just developing can be determined.

The control device can be part of a closed-loop control circuit for controlling a variable, and actuation can be performed when the closed-loop control circuit is deactivated, with the result that the control device has no effect on the controlled variable. As a result, it is possible to check the mechanical coupling using any desired control signals. The method can be carried out before or after operation of the closed-loop control circuit, with the result that the functioning of the mechanical coupling can be monitored over the long term without repercussions, particularly in the case of intermittent operation of the closed-loop control circuit.

The closed-loop control circuit can comprise a temperature control means of a cooling system for cooling an internal combustion engine in a motor vehicle, and actuation can be performed when the internal combustion engine is turned off. In a preferred embodiment, actuation is performed when the cooling system is also turned off. As a result, by way of example, after-cooling of the internal combustion engine or components which are connected to it can remain uninfluenced by the method being carried out.

A computer program product having programming means for carrying out the described method can be run on a processing device or stored in a computer-readable data storage medium.

An apparatus according to the invention for checking the above-described control device comprises a processing device for actuating the actuator with a predetermined control signal and a reading device for determining a profile of the actuating position which is read by the sensor. In this case, the processing device is designed to determine the functioning of the mechanical coupling of the actuator to the actuating element on the basis of the predetermined control signal and the determined profile.

As a result, it is possible to design a control device such that the sensor is mechanically coupled to the actuator instead of to the actuating element, without having to run the risk of an unnoticed defective mechanical coupling of the actuating element to the actuator.

In a preferred embodiment, the apparatus comprises a memory in which a predetermined profile of the actuating position which is associated with the control signal is stored, wherein the processing device is designed to detect a defect in the mechanical coupling if the determined profile deviates from the stored profile by more than a predetermined amount.

FIG. 1 shows a cooling system 100 on an internal combustion engine 105 of a motor vehicle. The cooling system 100 is used by way of example in the text which follows to explain the invention, wherein the invention is not restricted to an actuating device on the shown cooling system 100, but rather can be used, in principle, on any type of actuating element.

In the cooling circuit 100, heated coolant exits from the internal combustion engine 105 and is passed to a three-way valve 110. Depending on the position of the three-way valve 110, a first portion of the coolant is returned directly to the internal combustion engine 105, while a second portion of the coolant is routed to a radiator 115 where the coolant is cooled before it is returned to the internal combustion engine 105. The illustrated cooling system 100 can be realized in a large number of embodiments which are known by a person skilled in the art and is specified, by way of example, for an area surrounding a control device 120 which sets a position of the three-way valve 110.

The control device 120 comprises an actuator 125 which is connected to the three-way valve 110 by means of a first mechanical connection 130 and to a sensor 140 by means of a second mechanical connection 135. The actuator 125 and the sensor 140 are each connected to a processing device 145. The processing device 145 comprises a reading device for a signal which is provided by the sensor 140.

The processing device 145 preferably comprises a programmable microcomputer. The processing device 145 is also connected to a memory 150 and an interface 155.

The control device 120 receives a setpoint position, to which the three-way valve 110 is intended to be moved, via the interface 155. As long as both the first mechanical connection 130 and the second mechanical connection 135 are intact, a sensor signal of the sensor 140 reflects the position of the three-way valve 110. The processing device 145 calculates a difference between the setpoint position received via the interface 155 and the actual position which is read by means of the sensor 140 and outputs a corresponding control signal to the actuator 125 in order to bring the actual position closer to the setpoint position.

Since a possibly hot and electrically conductive coolant flows through the three-way valve 110, the sensor 140 is not coupled directly to the three-way valve 110 but rather to the actuator 125 by means of the second mechanical connection 135. The second mechanical connection 135 can be designed in a highly operationally reliable manner on account of short connections and an installation space which is usually sufficient. By way of example, the three-way valve 110 and the sensor 140 can be arranged at different ends of a shaft which drives the actuator 125.

The first mechanical connection 130 between the actuator 125 and the three-way valve 110 may be exposed to a series of loads which can lead to damage or to wear of the first mechanical connection 130. In this case, when the actuator 125 is actuated by the processing device 145 by means of a control signal, the sensor 140, but not the three-way valve 110, is adjusted. In order to determine a defect of this kind in the control device 120, the processing device 145 detects a profile, which is read by means of the sensor 140, of the actual position and compares this profile with a predetermined profile which is stored in the memory 140.

In one embodiment, a number of different predetermined profiles are stored in the memory 150, said profiles being associated with different control signals of the processing device 145 to the actuator 125. If the actuator 125 is not mechanically coupled to the three-way valve 110 owing to the defective first mechanical connection 130, a difference is produced between the profile which is read by means of the sensor 140 and the predetermined profile which is stored in the memory 150. If this difference exceeds a predetermined threshold, it is assumed that the first mechanical connection 130 is defective.

In a variant, a dynamic parameter of the first mechanical connection 130 can be determined on the basis of the control signal which is output to the actuator 125 and the profile which is read by means of the sensor 140. In this case, a corresponding predetermined dynamic parameter, which is again associated with the control signal in a preferred embodiment, is stored in the memory 150 instead of the profile. If the determined parameters and the parameters which are stored in the memory 150 differ by more than a predetermined amount, it is likewise assumed that the first mechanical connection 130 is defective.

The defective first mechanical connection 130 can be determined both during operation of the control device 120 or of the cooling system 100 and also in a dedicated test run which is advantageously carried out outside normal operation of the cooling system 100. In the test run, a control signal to the actuator 125 can be used, said control signal allowing particularly meaningful values to be compared. By way of example, the three-way valve 110 can be moved from one extreme position to another, a specific sequence of movements, preferably in alternating directions, can be used, or the three-way valve 110 can be adjusted to such an extent that it runs against a mechanical position limiting means.

Figure 2:
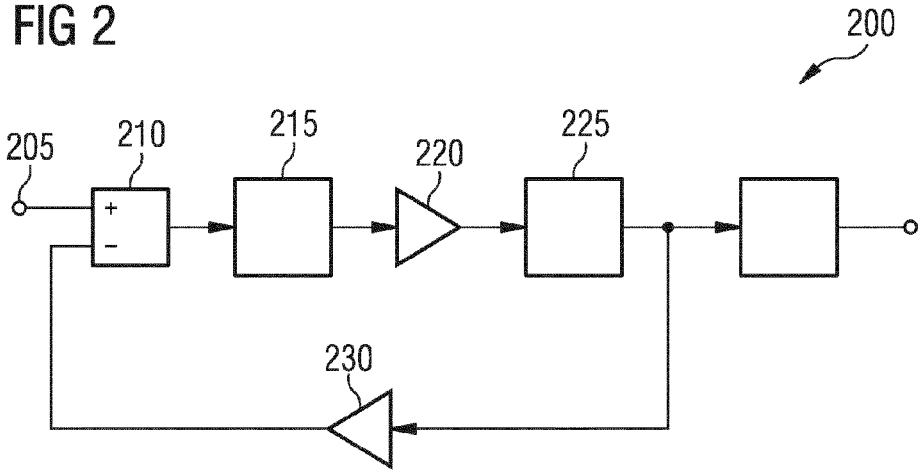
FIG. 2 shows a system model of the control device from FIG. 1.

FIG. 2 shows a system model 200 of the control device 120 from FIG. 1. The system model 200 models the effect of the control signal which is provided by the actuator 125 from FIG. 1 on the position which is read by means of the sensor 140.

The control signal 205 is reduced in a difference calculator 210 by a voltage which is generated by the electrical actuator 125 on account of its inherent induction. The resulting voltage is subjected to an electrical characteristic 215 which is formed substantially by an inductance and a resistance of the electrical actuator 125. As a result, a constant current is set, this current being converted into a constant torque 220 which, for its part, is subjected to a dynamic behavior 225 of the mechanical components which are connected to the actuator 125. The mechanical components comprise the first mechanical connection 130, the three-way valve 110, the second mechanical connection 135 and the sensor 140 in FIG. 1. If the first mechanical connection 130 is damaged, that is to say released, the mechanical influence of said first mechanical connection and the mechanical influence of the three-way valve 110 in the dynamic behavior 225 is absent. A moment of inertia J and damping B of the mentioned mechanical components are modeled in particular in the dynamic behavior 225.

An operating rate is set on account of the dynamic behavior 225, the self-induction 230 which is sent to the difference calculator 210 being performed on the basis of said operating rate. Furthermore, the position of the actuator 125 which can be read by means of the sensor 140 is determined on the basis of the operating rate by means of integration 235 with respect to time.

The presented technique is based on detecting a modified influence of the dynamic behavior 225 which is produced when the first mechanical connection 130 is only restricted or is no longer present at all.

Figure 3:
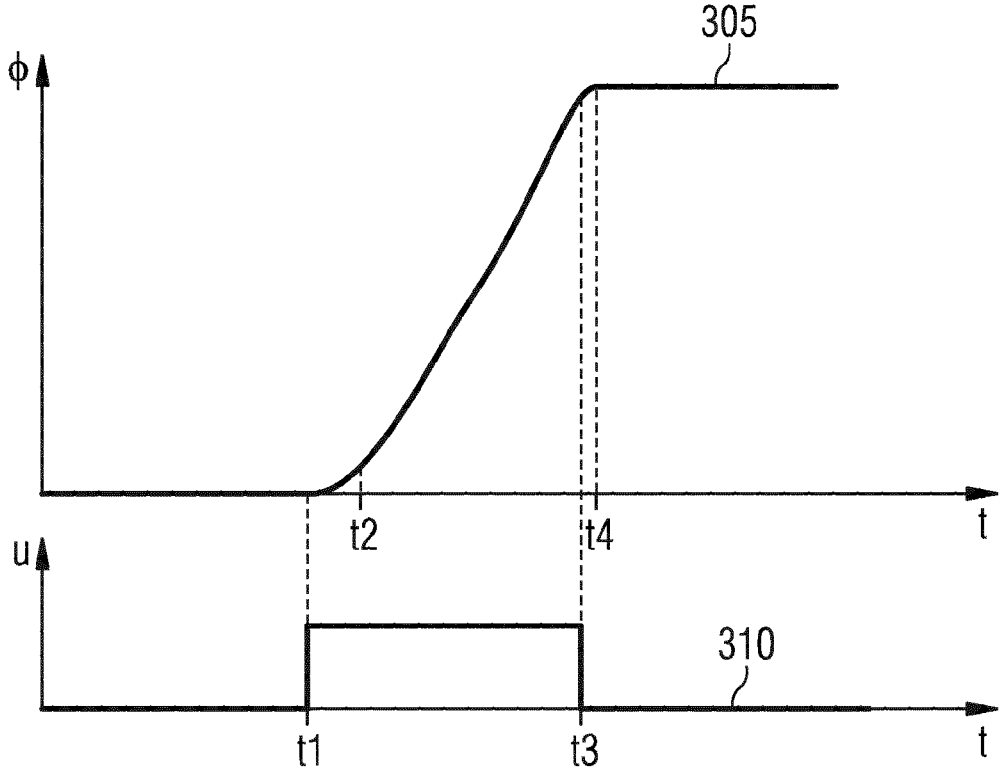
FIG. 3 shows a graph of a pulse response of the control device from FIG. 1.

FIG. 3 shows a graph 300 of a pulse response of the control device 120 from FIG. 1. Time is plotted in the horizontal direction, an adjustment angle Φ of the three-way valve 110 is illustrated in an upper region of the illustration of FIG. 3 and a voltage U of the control signal which is provided to the actuator 125 is illustrated in a lower region in a vertical direction. A profile 305 which describes a position Φ is illustrated in the upper region and a profile 310 which represents a control signal is illustrated in the lower region. For reasons of simplicity, a customary pulse-width modulation signal (PWM) is not used in this case, but rather a constant control voltage. In this case, it is assumed that the actuator 125 comprises an electric motor which controls the position of the three-way valve 110 over the rotation angle Φ.

The control signal is activated at time t1. The profile 305 of the position Φ increases up to time t2 at an increasing rate.

The profile 305 of the position Φ increases at a constant rate until the control signal is switched off again at time t3. After time t3, the rate of the increase in the profile 305 is reduced, until there is no further change in the position Φ at time t4.

The sections of the profile 305 of the position Φ between times t1 and t2 or between t3 and t4 provide information about the moment of inertia J and the damping B of the actuator 125 by the mechanical components which are driven by it. The greater, for example, the mass which is made to move by the actuator 125, the greater the moment of inertia J and the greater the time periods between t1 and t2 or between t3 and t4. The greater a mechanical frictional resistance of the actuator 125, the greater the damping B and the smaller the time interval between t3 and t4.

Figure 4:
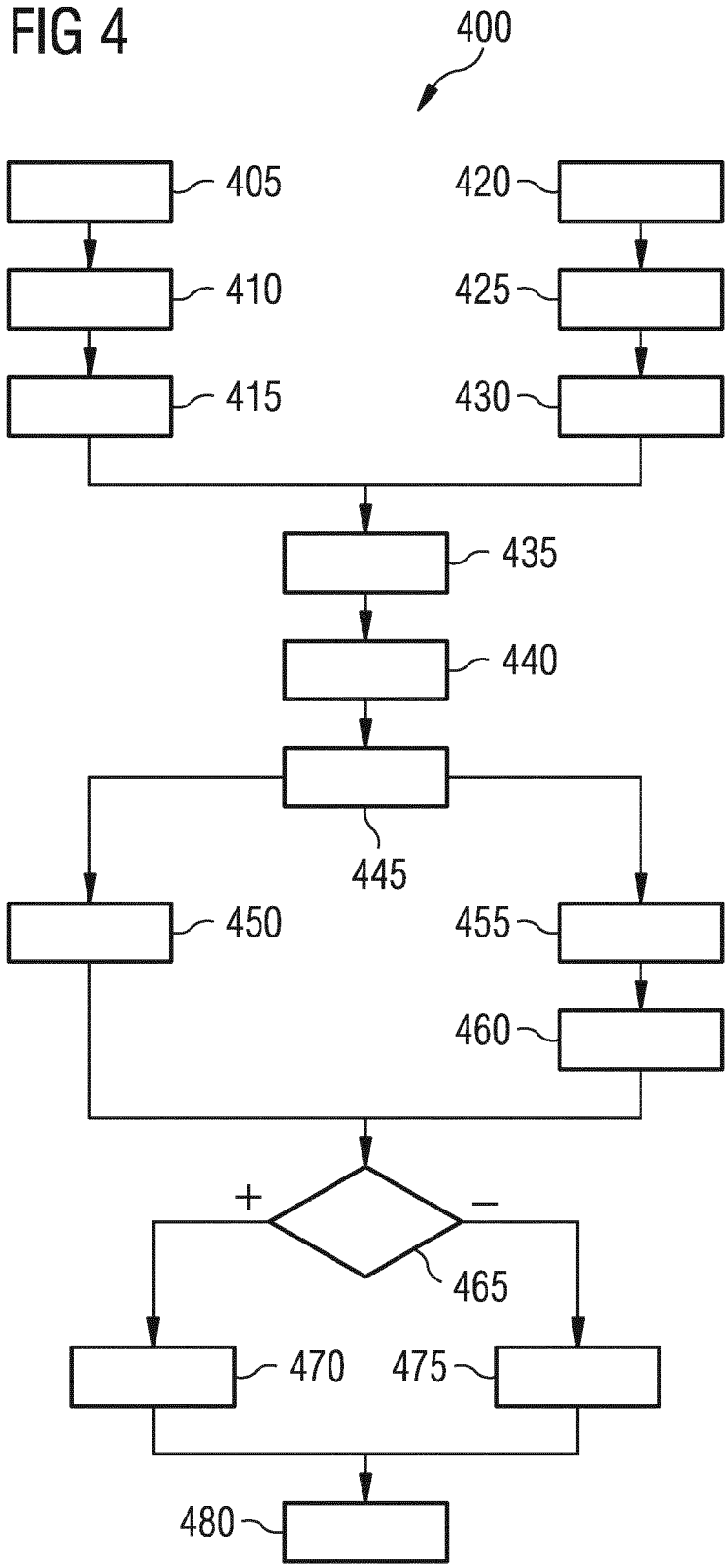
FIG. 4 shows a flowchart of a method for checking the control device from FIG. 1.

FIG. 4 shows a flowchart of a method 400 for checking the control device 120 from FIG. 1.

A temperature of the internal combustion engine 105 is detected in step 405. In a subsequent step 410, the detected temperature is compared with a predetermined value. In step 415, a position which is provided to the control device 120 by means of the interface 155 is determined on the basis of this comparison. Steps 405 to 415 correspond to operation of a cooling system 100 in normal operation.

As an alternative to steps 405 to 415, stopping of the internal combustion engine 105 can also be determined in a step 420, stopping of the cooling system 100 can be detected in a step 425, and a position which is particularly suitable for the subsequent determination of the functioning of the first mechanical connection 130 can be provided in a subsequent step 430, without operation of the internal combustion engine 105 being disturbed by the determination process.

After the position has been provided in one of the described ways, the actuator 125 is actuated with a control signal, which has been determined on the basis of a difference of an existing position which is read by means of the sensor 140 and the position, in a subsequent step 435.

While the actuator 125 is actuated, a series of actuating positions is read by means of the sensor 140 in a step 440. A profile is determined from the read actuating positions in a step 445.

In a first variant of the method 400, the profile which is determined in step 445 is compared with a predetermined profile which is stored in the memory 150. In a second variant of the method 400, one or more dynamic parameters of the mechanical connection 130 between the actuator 125 and the three-way valve 110 are determined in a step 455. The determined parameters are compared with predetermined parameters in a step 460, said predetermined parameters being stored in the memory 150.

After the comparison of one of steps 450 or 460, a check is made in a step 465 to determine whether the comparison results in a deviation which lies above a predetermined threshold value. If this is the case, it is concluded in a step 470 that the first mechanical connection 130 is defective. Otherwise, functioning of the first mechanical connection 130 is determined in a step 475. In both cases, the method ends in a subsequent step 480.

What is claimed is:

1. A method for checking a control device comprising an actuator for operating an actuating element in a cooling system of an internal combustion engine and a sensor for reading a position of the actuating element, wherein the control device is part of a closed-loop control circuit for controlling a variable, the method comprising:

actuating the actuator with a predetermined control signal while the closed-loop control circuit is deactivated so that the actuation does not affect the controlled variable;

determining a profile of the actuating position which is read by the sensor; and determining the functioning of the mechanical coupling of the actuator to the actuating element on the basis of the predetermined control signal and the determined profile.

2. The method of claim 1, comprising determining a defect in the mechanical coupling if the determined profile deviates from a predetermined profile associated with the predetermined control signal by more than a predetermined amount.

3. The method of claim 1, comprising:

determining a dynamic parameter of the mechanical coupling based on the determined profile, and determining a defect in the mechanical coupling if the determined parameter deviates from a predetermined parameter by more than a predetermined amount.

4. The method of claim 3, wherein the parameter comprises mechanical damping.

5. The method of claim 3, wherein the parameter comprises mechanical inertia.

6. The method of claim 1, wherein the closed-loop control circuit comprises a temperature control means for a cooling system for cooling an internal combustion engine in a motor vehicle, and actuation is performed when the internal combustion engine is turned off.

7. The method of claim 6, wherein the actuation is performed when the cooling system is also turned off.

8. An apparatus for checking a control device comprising an actuator for operating an actuating element in a cooling system of an internal combustion engine and a sensor for reading a position of the actuating element, wherein the control device is part of a closed-loop control circuit for controlling a variable, the apparatus comprising:

a processing device configured to actuate the actuator with a predetermined control signal while the closed-loop control circuit is deactivated, so the actuator does not affect the controlled variable;

a reading device configured to determine a profile of the actuating position which is read by the sensor; and the processing device further configured to determine the functioning of the mechanical coupling of the actuator to the actuating element based on the predetermined control signal and the determined profile.

9. The apparatus of claim 8, further comprising a memory storing a predetermined profile of the actuating position associated with the control signal, and wherein the processing device is configured to detect a defect in the mechanical coupling if the determined profile deviates from the stored profile by more than a predetermined amount.

10. The apparatus of claim 8, wherein the processing device is configured to:

determine a dynamic parameter of the mechanical coupling based on the determined profile, and determine a defect in the mechanical coupling if the determined parameter deviates from a predetermined parameter by more than a predetermined amount.

11. The apparatus of claim 10, wherein the parameter comprises mechanical damping.

12. The apparatus of claim 10, wherein the parameter comprises mechanical inertia.

13. The apparatus of claim 8, wherein the closed-loop control circuit comprises a temperature control means for a cooling system for cooling an internal combustion engine in a motor vehicle, and the processing device is configured to actuate the actuator when the internal combustion engine is turned off.

14. The apparatus of claim 13, wherein the processing device is configured to actuate the actuator when the cooling system is also turned off.

15. A non-transitory computer-readable medium storing a computer program product for checking a control device comprising an actuator for operating an actuating element in a cooling system of an internal combustion engine and a sensor for reading a position of the actuating element wherein the control device is part of a closed-loop control circuit for controlling a variable, the computer program product comprising instructions and executable by a processor to:

actuate the actuator with a predetermined control signal while the closed-loop control circuit is deactivated, so the actuator does not affect the controlled variable;

determine a profile of the actuating position which is read by the sensor; and determine the functioning of the mechanical coupling of the actuator to the actuating element on the basis of the predetermined control signal and the determined profile.

16. The non-transitory computer-readable media of claim 15, wherein the instructions are executable to determine a defect in the mechanical coupling if the determined profile deviates from a predetermined profile associated with the predetermined control signal by more than a predetermined amount.

17. The non-transitory computer-readable media of claim 15, wherein the instructions are executable to:

determine a dynamic parameter of the mechanical coupling based on the determined profile, and determine a defect in the mechanical coupling if the determined parameter deviates from a predetermined parameter by more than a predetermined amount.

* * * * *